US006982421B2

(12) United States Patent
Sato et al.

(10) Patent No.: US 6,982,421 B2
(45) Date of Patent: Jan. 3, 2006

(54) EXTREME ULTRAVIOLET SOURCE

(75) Inventors: Hiroto Sato, Mishima (JP); Kazunori Bessho, Numazu (JP); Yusuke Teramoto, Shizuoka-ken (JP); Daiki Yamatani, Shizuoka-ken (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/006,633

(22) Filed: Dec. 8, 2004

(65) Prior Publication Data

US 2005/0151455 A1 Jul. 14, 2005

(30) Foreign Application Priority Data

Dec. 26, 2003 (JP) ..... 2003-432961

(51) Int. Cl.
*H05G 2/00* (2006.01)
*H01J 17/26* (2006.01)
*H01J 49/00* (2006.01)

(52) U.S. Cl. ..... 250/365; 250/504 R; 250/461.1; 250/493.1; 313/231.61; 313/231.71

(58) Field of Classification Search ..... None
See application file for complete search history.

(56) References Cited

U.S. PATENT DOCUMENTS 6,075,838 A * 6/2000 McGeoch ..... 378/119
6,188,076 B1 2/2001 Silfvast et al.
6,815,900 B2 * 11/2004 Ahmad et al. ..... 315/111.21
2001/0026402 A1 * 10/2001 Gerhard et al. ..... 359/731
2002/0025684 A1 * 2/2002 Butterbaugh et al. ..... 438/712
2004/0145292 A1 * 7/2004 Ahmad et al. ..... 313/231.31
2005/0072942 A1 * 4/2005 Barthod et al. ..... 250/504 R
2005/0117134 A1 * 6/2005 Nagasaka et al. ..... 355/30
2005/0122491 A1 * 6/2005 Bakker et al. ..... 355/30
2005/0151455 A1 * 7/2005 Sato et al. ..... 313/231.61

FOREIGN PATENT DOCUMENTS

EP 1549116 * 6/2005

* cited by examiner

*Primary Examiner*—Nikita Wells
*Assistant Examiner*—Bernard E. Souw
(74) *Attorney, Agent, or Firm*—Nixon Peabody LLP; David S. Safran

(57) ABSTRACT

To both increase the efficiency of conversion into EUV radiation energy and also increase the amount of emerging EUV radiation in an EUV source a discharge tube is connected to a gas supply space for supply of the discharge gas which in located radially with respect to an optical axis. The discharge gas is supplied to the discharge space through the gas supply space, passes through the center opening of the anode, emerges from the discharge part and is afterwards evacuated from an evacuation opening. The anode and the cathode are connected to a pulse current source. Discharge plasma is produced and EUV radiation is formed by a heavy current pulse from the pulse current source within the discharge space of the discharge tube. The EUV radiation which has formed passes through a through-opening of the anode and is emitted to the outside.

4 Claims, 4 Drawing Sheets

Fig. 3(a)
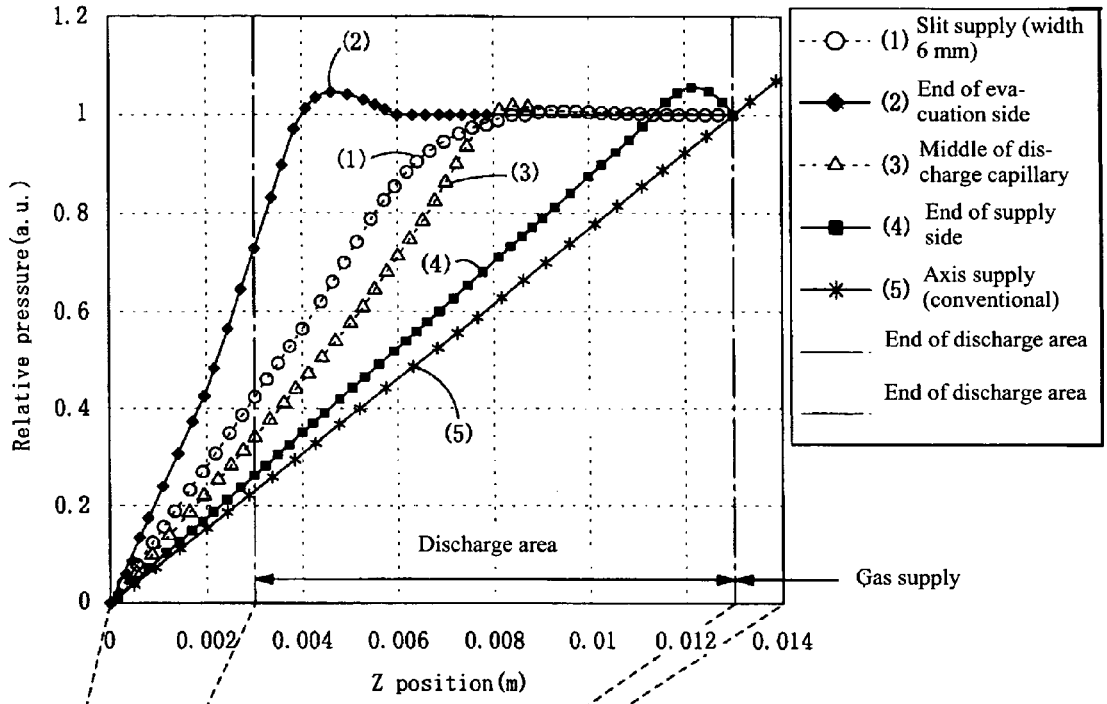
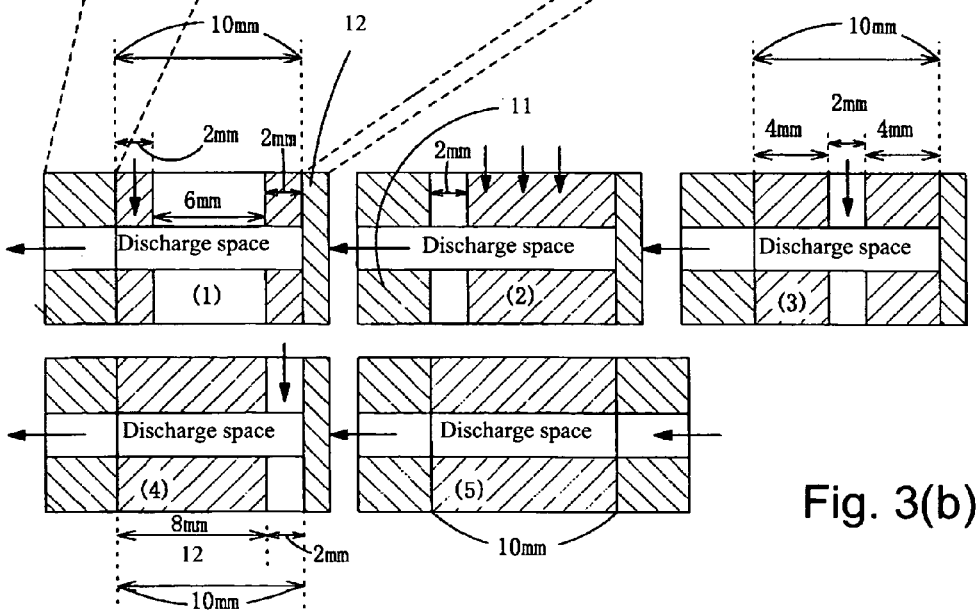
Fig. 3(b)

EXTREME ULTRAVIOLET SOURCE

BACKGROUND OF THE INVENTION

1. Field of Invention

The invention relates to an EUV source (EUV=extreme ultraviolet) in which EUV radiation is produced by a high temperature plasma which has been produced by a discharge, such as, for example, an EUV source which is used for a semiconductor lithography device, bioanalysis, material structural analysis, or the like.

2. Description of Related Art

An EUV source of the so-called Z-pinch type as is described, for example, in Japanese patent disclosure document JP-A-2002-507832 (and corresponding U.S. Pat. No. 6,075,838), is known as a light source which is used for semiconductor lithography or the like and in which EUV radiation with a wavelength from roughly 10 nm to 15 nm is produced. Here, the following takes place:

- an emission gas such as xenon gas or the like is introduced into the space between the anode and the cathode;
- afterwards, an electrical pulse with high energy is applied between the anode and the cathode and a discharge current is allowed to flow;
- the current is allowed to be pinched by its own magnetic field which is formed hereby, in the direction to its center axis; and
- as a result, plasma with a high temperature and a high density is produced, and thus, EUV radiation is generated.

Japanese patent disclosure document JP-A-2003-518316 (and corresponding U.S. Pat. No. 6,188,076) shows a process with a so-called capillary tube discharge, in which the following is carried out:

- a cathode and an anode are placed on the two ends of an insulator constituted by a narrow tube with a narrow opening;
- a pulse voltage is applied between the electrodes;
- by closing the discharge current which is flowing, the current density is increased by the wall of the narrow tube;
- as a result, a high temperature plasma is produced and EUV radiation is allowed to form.

In each of the above described EUV sources, EUV radiation is emitted by a high temperature plasma which is produced by the discharge. The EUV radiation which has been formed emerges to the outside from the discharge part, is routed, for example, to an exposure device for semiconductor lithography, and is used.

The EUV radiation is easily absorbed by the material. When there is residual gas or the like in the path of the radiation, it is absorbed by it, by which its intensity is reduced. If, for example, EUV radiation with a wavelength of 13 nm propagates 1 m in xenon gas with a pressure of 10 Pa, its intensity decreases to roughly 1/500. The attenuation factor of EUV radiation differs depending on the type of residual gas. However, it is necessary to evacuate such that the pressure of the residual gas in the area which corresponds to the path of the EUV radiation is as low as possible, for example, at most 1 Pa.

In the prior art, within a hermetically closed vessel, there is a discharge part. The discharge gas is supplied from one side of the space between the cathode and the anode (discharge space). The discharge gas is allowed to escape from the other side. The discharge gas which has been allowed to escape from the discharge space to the outside is evacuated by a pump from the hermetically closed vessel in order to suppress as much as possible the attenuation of the EUV radiation by the residual gas.

FIG. 4 shows one example of the arrangement of the discharge part according to the prior art.

In FIG. 4, a first electrode 11 (anode), a second electrode 12 (cathode), and a discharge tube 13 are shown. The discharge tube 13 is clamped as an insulator between the first electrode 11 and the second electrode. The first electrode 11 and the second electrode 12 are connected to a pulse current source from which a heavy current pulse is supplied. The discharge gas 25 is introduced through an opening of one electrode, e.g., cathode 12 into the discharge tube (insulator) 13 and is allowed to escape through the opening of the other electrode, e.g., anode 11. Here, the distribution of the pressure of the discharge gas which has been introduced into the discharge space before starting the discharge (initial gas pressure) in the direction of the optical axis from curve C1 is shown in the graph at the bottom in FIG. 4. It can be imagined that it is high on the side of gas supply and is low on the side of gas escape. As was described above, the loss by absorption is smaller, the lower the residual gas pressure in the area in which the EUV radiation is propagating. Normally, the EUV radiation is therefore allowed to escape on the gas escape side and used.

If, in the arrangement of the discharge part shown in FIG. 4, the gradient of the initial gas pressure in the discharge space is large in the direction of the optical axis, the problem arises that the efficiency of the conversion of input electrical energy into EUV radiation energy in the desired wavelength range (hereinafter, also called only conversion efficiency) decreases. Even if the electrical energy consumed for discharge is the same, the area of the easily emittable wavelength differs when the temperature and the density of the generated plasma differ.

In order to obtain EUV radiation with the desired wavelength with high efficiency, it is therefore necessary for the temperature and the density of the plasma to be in a suitable parameter range. The wider the area in which plasma is produced within this parameter range, the greater the light intensity in the required wavelength range of the EUV radiation obtained and the higher the conversion efficiency becomes.

However, if the initial gas pressure has a gradient and if the initial gas density is nonuniform in space, the temperature and the density of the plasma which has been heated by the discharge become nonuniform in space and the area of the plasma which has an optimum parameter range becomes narrow. As a result, the conversion efficiency is reduced.

When the gradient of the initial gas pressure is reduced, the uniformity of the plasma increases. In order to reduce the gradient of the initial gas pressure in the conventional arrangement of the discharge part, the flow quantity of the supplied gas and the pressure on the gas supply side must be reduced.

The reason for this is the following:

As described above, to prevent loss of EUV radiation by the residual gas, it is necessary to substantially expose the gas escape side to vacuum evacuation. The gradient of the initial pressure cannot be reduced by increasing the pressure on the gas evacuation side.

If the pressure on the gas supply side is reduced, the distribution of the initial gas pressure in the direction of the optical axis is plotted by the curve C2 in the graph in FIG. 4, bottom. The gradient decreases. However, since the pressure value also decreases overall, the absolute density of the plasma which has been produced by the discharge decreases. Here, the disadvantage arises that EUV radiation emergence with the required magnitude cannot be achieved.

As was described above, in the arrangement of the discharge part in the prior art, it is difficult to achieve both an increase in conversion efficiency and also an increase of light intensity at the same time.

SUMMARY OF THE INVENTION

The invention was devised to eliminate the above described disadvantage in the prior art. Thus, a primary object of the invention is to make the initial density within the discharge tube uniform in space in an EUV source in which EUV radiation is produced by a high temperature plasma which results from a discharge, and thus, both to increase the conversion efficiency of the electrical energy into EUV radiation energy and also to increase the output of EUV radiation.

The above described object is achieved in accordance with the invention as follows:

(1) In an EUV source which comprises:

an insulator which has a discharge space inside;

a first electrode which is located on the side of one end of this insulator; and a second electrode which is located on the side of the other end of this insulator, in which emission gas is allowed to flow into the above described discharge space, in which a pulse voltage is applied to the above described first electrode and the above described second electrode, and in which the EUV radiation which has been formed within the above described discharge space is emitted from the side of the first electrode, the object is achieved in that the side of one end of the discharge space is sealed by the second electrode and that, within the insulator, a gas supply space for supply of discharge gas which has access to the discharge space is located in the radial direction with respect to the optical axis.

(2) The gas supply space is arranged from the side of the first electrode beyond the middle of the discharge space in the direction of the optical axis to the side of the second electrode.

(3) The gas supply space is arranged at a site which is nearer the first electrode than the middle of the discharge space in the direction of the optical axis.

(4) The gas supply space is located in the middle of the discharge space in the direction of the optical axis.

Action of the Invention

In an EUV source in which EUV radiation is produced by a high temperature plasma, the initial gas density within the discharge tube can be made uniform in space by the invention. Therefore, the conversion efficiency of the electrical energy into EUV radiation energy can be increased and an EUV source with high emergence of EUV radiation can be obtained.

The invention is described further detail below with reference to the accompanying drawings.

BRIEF DESCRIPTION OF THE DRAWINGS

FIG. 3(*a*) shows a schematic of the gas pressures on the anode and the through opening of the discharge tube;

FIG. 3(*b*) shows a schematic of the positional relationship of the discharge space of an EUV source relative to the gas supply space and FIG. 4 shows a schematic of one example of the arrangement of the discharge part in the prior art.

DETAILED DESCRIPTION OF THE INVENTION

Figure 1:
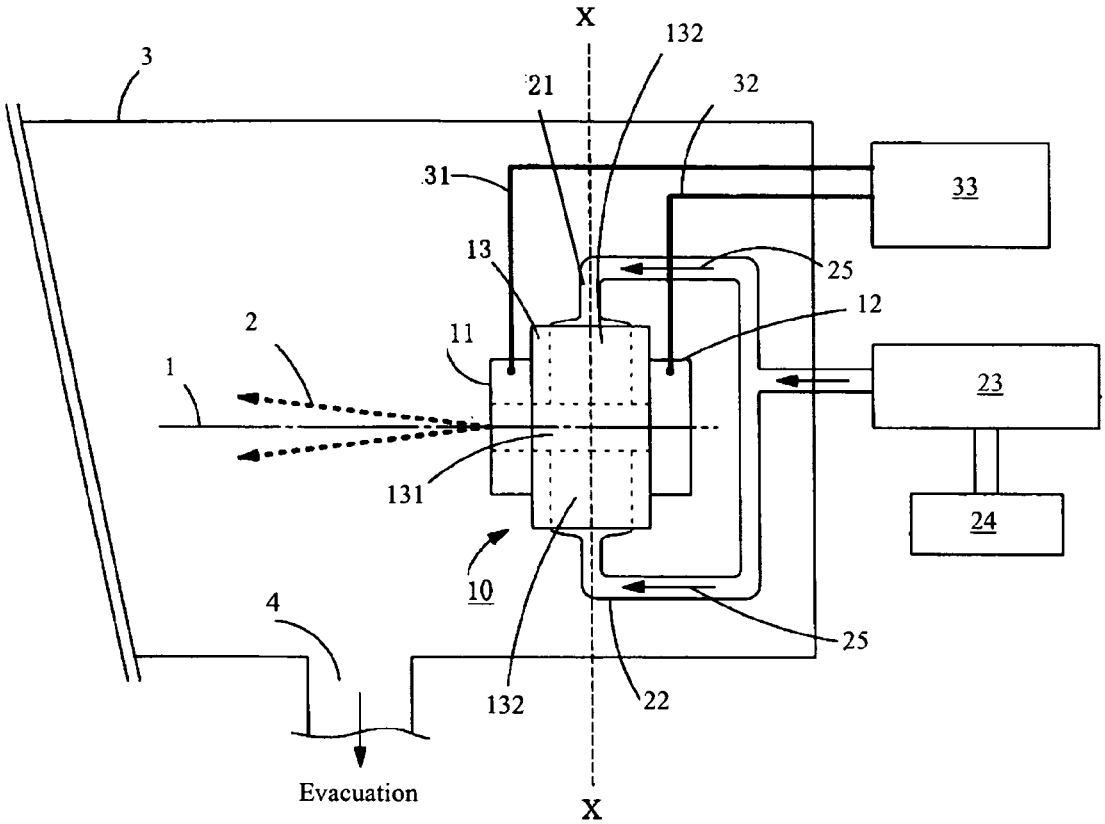
FIG. 1 is a schematic of an EUV source according to one embodiment of the invention.

FIG. 1 shows a schematic of an EUV source according to one embodiment of the invention having a vessel 3 which can be vacuum-evacuated. In the vessel 3, there is a discharge module 10 in which a discharge tube 13, as an insulator, is clamped between an anode 11 which serves as a first electrode and a cathode 12 which serves as a second electrode. The anode 11 and the discharge tube 13 each have a central through-opening. The center axes of these through-openings are aligned with another and form an optical axis 1. Furthermore, the through opening of the discharge tube 13 forms a discharge space 131. The cathode 12 does not have a through opening. The end on the cathode side of the discharge space 131 of the discharge tube 13 is sealed by the cathode 12. In the discharge tube 13, in the radial direction with respect to the optical axis 1, there is a gas supply space 132 for supply of the discharge gas and it has access to the discharge space 131. The gas supply space 132, in this embodiment, is located, from the side of the anode 11 which is the first electrode, beyond the center X in the direction of the optical axis of the discharge space 131 to the side of the cathode 12 which is the second electrode in the radial direction with respect to the optical axis 1.

The discharge gas 25 can be supplied from a gas bomb 24 via a gas flow regulator 23 through tubes 21, 22 for introducing discharge gas into the discharge space 131 of the discharge tube 13. The supplied discharge gas 25 passes through the center opening of the anode 11, emerges from the discharge part and is evacuated through the evacuation opening. Thus, the inside of the vessel 3 is shifted essentially into a vacuum state.

The anode 11 and the cathode 12 are each electrically connected to the pulse current source 33 by an electrical conductor 31 for the anode and an electrical conductor 32 for the cathode. By the output of the heavy current pulse from the pulse current source 33, within the discharge space 131 of the discharge tube 13, a discharge plasma is produced and EUV radiation 2 is formed. The EUV radiation 2 which has been formed is emitted through the through opening of the anode 11 from the discharge module 10, routed, for example, to an optical system for wafer exposure of a lithography device or the like, and used.

Figure 2A:
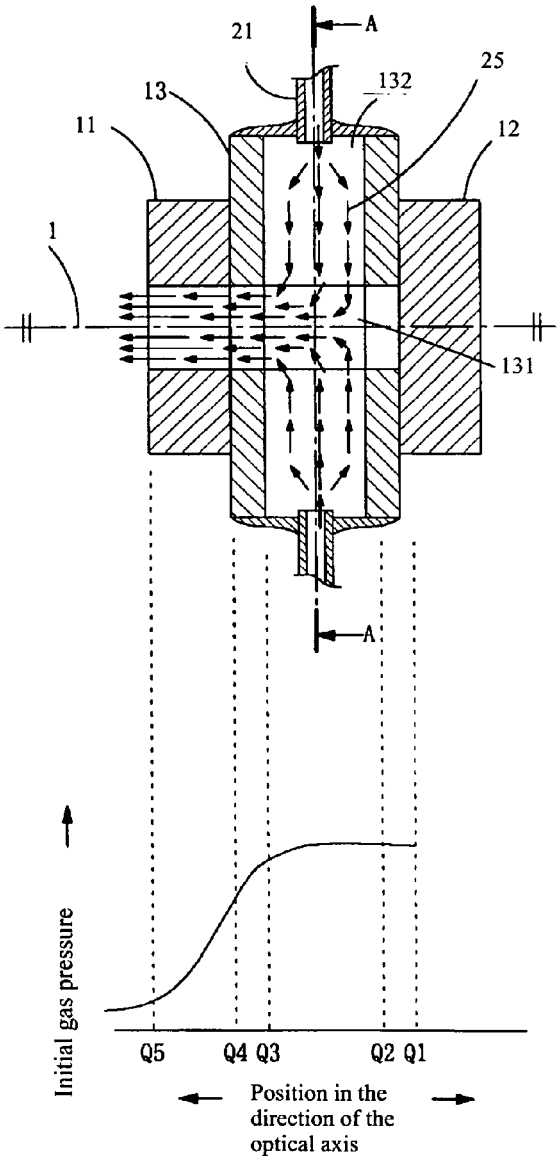
FIGS. 2(*a*) & 2(*b*) are, respectively, longitudinal and transverse cross sections of a discharge module and a schematic of the distribution of the initial gas pressure along the optical axis.
Figure 2B:
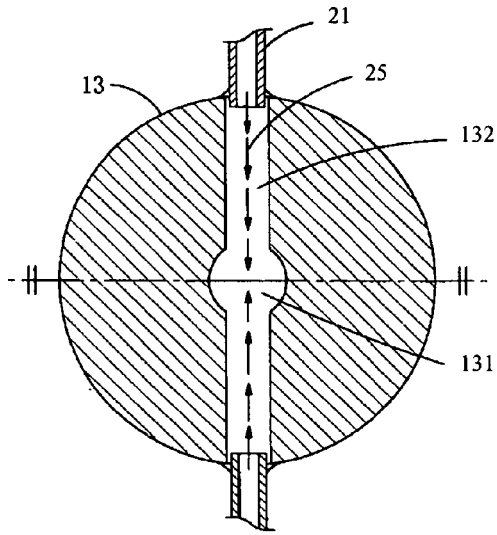
Figure 4:
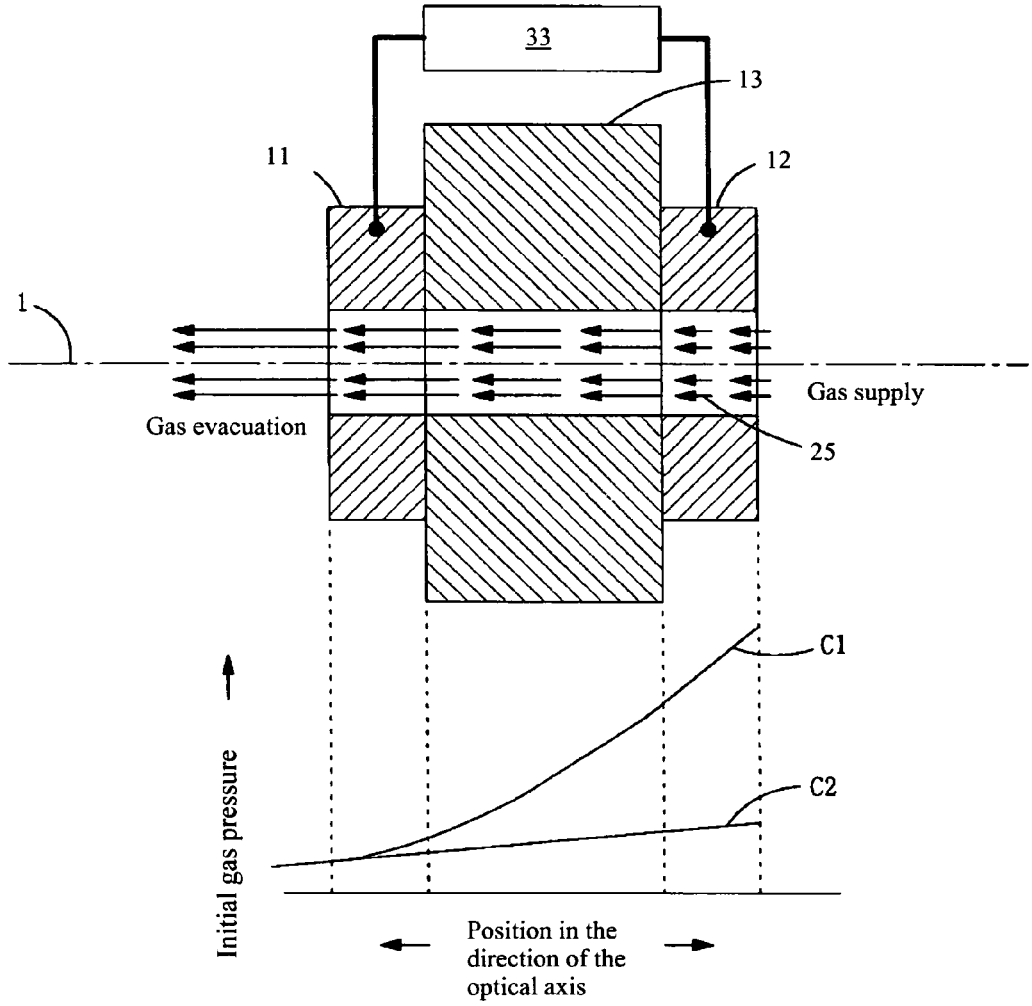
Fig. 4 (Prior Art)

FIG. 2(*a*) is a cross section of the discharge module 10 with a schematic of the distribution of the initial pressure along the optical axis. FIG. 2(*b*) shows a cross section taken along line A—A in FIG. 2(*a*).

The discharge tube 13 has a through opening which is located in the axial direction and which forms the discharge space 131. The discharge space 131 has access to the gas supply space 132. In the path which is shown in the drawings using the arrows, the discharge gas 25 is supplied to the discharge space 131. The points Q1 to Q5 in the graph correspond to the positions in the direction of the optical axis of the discharge tube 13 to which they are connected by dotted lines.

The discharge space 131 is located between the positions Q1 and Q4 in the direction of the optical axis. The discharge plasma is formed between positions Q1 and Q4. As is apparent from FIG. 2(*a*), the initial gas pressure is distributed essentially over the entire region of the discharge space 131 in the direction of the optical axis with a high pressure and in a uniform manner.

As was described above, in the direction of the optical axis there is hardly any pressure gradient for the initial gas pressure. The temperature and the density of the plasma which has been heated by the discharge are made uniform in space. The area of the plasma which has an optimal parameter range is wide. As a result, the conversion efficiency is increased.

The initial gas pressure value in itself can also be increased. The absolute density of the generated plasma is therefore high. The amount of emerging EUV radiation also increases. This means that both an increase of the conversion efficiency and also an increase of the light intensity are possible.

In the discharge space 131, in the direction perpendicular to the optical axis (radial direction), a distribution of the initial gas pressure is formed. However, this has hardly any effect on the conversion efficiency. The reason for this is because, during the discharge, the plasma is more or less pinched by the pinch effect in the direction toward the center of the optical axis. It can be imagined that the density of the plasma is a function of the integration value of the initial gas pressure in the radial direction.

FIG. 3(*a*) shows the gas pressure at the anode 11 and at the through opening of the discharge tube 13. FIG. 3(*b*) shows the positional relationship of the discharge space of the EUV source to the gas supply space. The graph in FIG. 3(*a*) shows the gas pressure within the through-opening in a relative manner in the case in which the pressure at the output of the through-opening of the anode 11 is fixed at 0.

FIG. 3(*b*) shows the pattern in the case of several changes of the positional relationship of the discharge section relative to the gas supply space. In FIG. 3(*b*), the dimensions are recorded from which the positional relations between the discharge space 131, the discharge tube 13, the anode 11 and the cathode 12 become apparent.

The x-axis in FIG. 3(*a*) corresponds to the position in the direction of the optical axis as shown in FIG. 3(*b*). The y-axis plots the relative value of the gas pressure within the through opening. In FIG. 3(*a*), the dot-dash lines represent the ends of the discharge area as shown in FIG. 3(*b*). The area between the dot-dash lines is the discharge space area.

In FIG. 3(*a*), the curves (1) to (5) each plot the respective gas pressure distribution in the case in which the gas supply space 132 has been arranged according to patterns (1) to (5) in FIG. 3(*b*). The gas pressure distribution is shown according to the arrangement of the gas supply space 132 using the curves (1) to (5) in FIG. 3(*a*). The conversion efficiency of the EUV radiation is shown below.

(1) Curve (1)

For the arrangement which is shown in FIGS. 1 & 2, the gas pressure distribution is shown in the case in which the gas supply space 132 was located beyond the center of the discharge space 131 from the side of the first electrode 11 in the direction of the optical axis as far as the second electrode 12 ((1) in FIG. 3(*b*)). In this case, the gas pressure on the side of the second electrode 12, which constitutes roughly half the discharge space 131, is in a uniform and high state. The EUV radiation can emerge with high efficiency due to the presence of this area.

(2) Curve (2)

The gas pressure distribution is shown in the case in which the gas supply space 132 was located nearer the side of the first electrode 11 than the direction of the optical axis of the discharge space 131 ((2) in FIG. 3(*b*)). In this case, the inside of the discharge space 131 is in the high gas pressure state which is essentially uniform.

(3) Curve (3)

The gas pressure distribution is shown in the case in which the gas supply space 132 is located essentially in the middle in the direction of the optical axis of the discharge space 131 ((3) in FIG. 3(*b*)). In this case, the gas pressure on the side of the second electrode 12, which constitutes roughly half the discharge space 131, is in a uniform and high state. The EUV radiation can emerge with high efficiency due to the presence of this area.

(4) Curve (4)

The gas pressure distribution is shown in the case in which the gas supply space 132 was located nearer the side of the second electrode 12 than the middle in the direction of the optical axis of the discharge space 131 (FIG. 3(*b*) (4)). In this case, it is shown that essentially the same gas pressure distribution as in the conventional example occurs. However, since the area in which the gas pressure does not decrease is slightly on the side of the second electrode 12, the light conversion efficiency of the discharge gas increases slightly more than in the conventional case.

(5) Curve (5)

This is a conventional example. As is shown by (5) in FIG. 3(*b*), there is no gas supply space. The gas flows from the second electrode 12 in the direction toward the first electrode 11. In this case, there is no area in the discharge space 131 in which the gas pressure becomes uniform. The light conversion efficiency of the discharge gas is low. Furthermore, there is the disadvantage that the desired light does not emerge with high efficiency.

As was described above, it can be imagined that EUV radiation can emerge with high efficiency by the measure that the gas supply space 132 is placed at least nearer the side of the first electrode 11 (EUV radiation emergence side) than the middle of the discharge space 131 in the direction of the optical axis.

In the embodiments shown above using FIGS. 1 to 3, a case was shown in which the gas supply space 132, with respect to the optical axis 1, in the radial direction is located symmetrically at the top and bottom. However, the same action can be obtained even if the gas supply space 132 is located radially around the optical axis 1 at several sites (least three sites).

Furthermore, the same effect can be expected even if the gas supply space 132 is located at only one site. For example, in FIGS. 1 to 3, the gas supply space 132 can also be located only on the top or only on the bottom relative to the optical axis 1.

What is claimed is:

1. An EUV source which comprises the following:

an insulator which has a discharge space inside;

a first electrode which is located on a first side of the insulator; and a second electrode which is located on an opposite side of the insulator, and an inlet for a flow of emission gas into the discharge space for producing EUV radiation within the discharge space when a pulse voltage is applied to the first and second electrodes, and an outlet at the first side of the insulator for emission of a plasma discharge, wherein the second electrode seals said opposite end of the discharge space, wherein a gas supply space is provided within the insulator for receiving said flow of emission gas, said gas supply space being connected upstream of the discharge space and being connected thereto, and wherein the gas supply space is located radially with respect to an optical axis of the EUV source.

2. EUV source as claimed in claim 1, wherein the gas supply space is arranged in the direction of the optical axis extending from the first side of the insulator to beyond the middle of the discharge space toward said opposite side of the insulator.

3. EUV source as claimed in claim 1, wherein the gas supply space is arranged at a site which, in the direction of the optical axis, is nearer the first electrode than the middle of the discharge space.

4. EUV source as claimed in claim 1, wherein the gas supply space is located in the middle of the discharge space in the direction of the optical axis.

* * * * *